US007456591B2

(12) United States Patent
Jongen

(10) Patent No.: US 7,456,591 B2
(45) Date of Patent: Nov. 25, 2008

(54) CYCLOTRON EQUIPPED WITH NOVEL PARTICLE BEAM DEFLECTING MEANS

(75) Inventor: Yves Jongen, Louvain-la Neuve (BE)

(73) Assignee: Ion Beam Applications S.A. (BE)

( * ) Notice: Subject to any disclaimer, the term of this patent is extended or adjusted under 35 U.S.C. 154(b) by 526 days.

(21) Appl. No.: 10/522,649

(22) PCT Filed: Jul. 18, 2003

(86) PCT No.: PCT/BE03/00124

§ 371 (c)(1),
(2), (4) Date: Jun. 20, 2005

(87) PCT Pub. No.: WO2004/010748

PCT Pub. Date: Jan. 29, 2004

(65) Prior Publication Data

US 2005/0269497 A1 Dec. 8, 2005

(30) Foreign Application Priority Data

Jul. 22, 2002 (EP) ..... 02447140

(51) Int. Cl.
*H05H 13/00* (2006.01)

(52) U.S. Cl. ..... 315/502; 315/501; 315/507; 313/62

(58) Field of Classification Search ..... 315/500–502, 315/505–507; 313/62, 359.1, 361.1; 250/251
See application file for complete search history.

(56) References Cited

U.S. PATENT DOCUMENTS 2,922,061 A * 1/1960 Teng ..... 313/62
3,794,927 A * 2/1974 Fleischer et al. ..... 315/500
4,771,208 A * 9/1988 Jongen et al. ..... 313/62
4,789,839 A * 12/1988 Morris ..... 315/502
5,874,811 A * 2/1999 Finlan et al. ..... 315/502
6,057,655 A * 5/2000 Jongen ..... 315/502

FOREIGN PATENT DOCUMENTS

NL 9302257 12/1993
WO WO 97/14279 4/1997

OTHER PUBLICATIONS

Goto et al. "Design of Injection System for the OPCR SSC (II)." *Science Papers I.P.C.R.*, Nov. 10, 1980, vol. 74, No. 4, pp. 124-145.
Yano et al. "Desin and Model Study of Injection Bending Magnet for RIKEN SSC." *Science Papers I.P.C.R.*, Nov. 9, 1981, vol. 75, No. 4, pp. 176-192.

* cited by examiner

*Primary Examiner*—Haissa Philogene
(74) *Attorney, Agent, or Firm*—Fitch, Even, Tabin & Flannery

(57) ABSTRACT

The invention concerns a cyclotron for accelerating a charged particle beam circulating in the median plane essentially in the form of two poles inducing a magnetic field and having a so-called axial injector, that is an injector arranged outside the cyclotron substantially along the main axis of the cyclotron and hence perpendicular to the median plane thereof and which is combined with deflecting means which enable the particle beam to be deflected until it is positioned in the median plane. The invention is characterized in that the deflecting means consist of a magnetic deflector.

20 Claims, 5 Drawing Sheets

CYCLOTRON EQUIPPED WITH NOVEL PARTICLE BEAM DEFLECTING MEANS

AIM OF THE INVENTION

This invention aims to propose a cyclotron equipped with a novel type of inflector used to "inflect" a charged particle beam injected axially by an injection device or an injector towards the median plane of the cyclotron.

PRIOR ART

Cyclotrons are charged particle accelerators used in particular in order to produce radioactive isotopes. These cyclotrons are based on the elementary principles of the force of Lorenz: $F=qv\times B$ which induces the fact that a charged particle essentially describes the arc of a circle in a uniform magnetic field perpendicular to the plane in which the charged particle moves.

Cyclotrons are comprised of several distinct main units such as the electromagnet which guides the charged particles, the high frequency resonator which is responsible for the acceleration of the said particles and finally the injection system of the said particles in the cyclotron.

The combination of the different means makes it possible to bring about the acceleration of charged particles which will describe in the median plane of the cyclotron (perpendicular to the magnetic field) a trajectory having a more or less spiral form with an increasing radius around the central (vertical) axis of the cyclotron which is perpendicular to the median plane.

In modern cyclotrons of the isochronous type, the poles of the electro-magnet are divided into sectors which alternately present a reduced air-gap and a larger air-gap. The azimuthal variation of the magnetic field which results from this is able to guarantee the vertical and the horizontal focusing of the beam during acceleration.

Amongst the isochronous cyclotrons, it is appropriate to distinguish the compact type cyclotrons which are energized by a pair of main circular coils and the so-called separate sector cyclotrons where the magnetic structure is divided into separate units which are entirely autonomous.

The high frequency resonator itself is made up of accelerating electrodes, frequently called "dees" for historical reasons. An alternating voltage of several tens of kilovolts is thus applied to the frequency of rotation of the particles in the magnet.

These charged particles accelerated by a cyclotron can be positive particles, such as protons, or negative particles, such as $H^-$ ions.

These latter particles (the $H^-$ ions in this instance) are extracted by converting the negative ions into positive ions by passing them through a sheet, for example of carbon, the function of which is to strip the negative ions of their electrons.

Nevertheless, the acceleration of such negative particles poses considerable difficulties.

The main disadvantage stems from the fact that the negative ions are fragile and so are easily dissociated by residual gas molecules or by considerable magnetic fields crossed with high energy and present in the cyclotron.

For this reason, it is imperative that the vacuum present in the cyclotron is very high.

In the same way, the injection device and the source, for these reasons, are located on the outside of the cyclotron. This makes it possible to prevent the cyclotron's air-gap from being polluted in any way.

Another reason for which the injection devices and the source are located on the outside of the cyclotron is that the space available within the cyclotron itself is very limited.

Normally, the injection devices and the source are located directly above the central axis of the cyclotron such that the generated particles are injected in a direction which is essentially vertical towards the centre of the cyclotron where they will be inflected progressively so as to be directed in the median plane (horizontal) of the cyclotron where they will be subjected to the different accelerations.

It is for this reason that the cyclotrons are called axial injector cyclotrons.

It is appropriate to note that with the natural design of the magnetic field within the cyclotron being itself vertical, the injection of the particle beam will therefore happen along the lines of the magnetic field, and the particles will not be deflected if the said magnetic field is not disturbed.

According to the prior art, in order to direct the particle beam in an appropriate manner in the median plane, i.e. perpendicular to the direction of injection, it is proposed to place inflectors in the cyclotron which progressively inflect the beam.

According to the prior art, the established inflectors are electrostatic inflectors which are essentially made up of a negative electrode and a positive electrode between which an electric field is created by a potential difference. This will progressively inflect the particle beam until it is correctly positioned tangentially in the median plane of the cyclotron and so perpendicularly in relation to its destination direction.

Actually the particle beam moves in a spiral helix.

In fact, as soon as they are under the effect of the electric field which is essentially horizontal and which is present between the electrodes at the entrance of the electrostatic inflector, the charged particles acquire a speed component in the horizontal plane and they are subjected to the force of Lorentz.

The combination of the two components generates a spiral movement of the particle beam within the central section of the cyclotron.

There are abundant descriptions of this type of device in the literature. In particular, document NL-A-9302257 describes this type of inflector.

The presence of an inflector of this type intended to allow the introduction of the particle beam through the central (vertical) axis generates the presence of a hole in the air-gap and therefore disturbs the vertical magnetic field.

The other disadvantages stem from the fact that these electrodes must be subjected to a potential difference which is all the more important as the intensity of the particle beam is important.

Yet, the current tendency is to want to increase the intensity of the beams which, at the moment, is between 300 and 500 μA up to values which can reach several mA.

Another significant problem stems from the fact that, in order to increase the intensity of the particle beam, the space charge is increased, i.e. the density of the electric charge, thus bringing about the electrostatic repulsion of the charges, and so a broadening of the beam (electric charges brought about by the presence of numerous charged particles which mutually repel one another within a space, thus causing an increase in the beam size). This space charge depends, of course, on the intensity of the beam speed. In order to reduce the space charge, it is therefore necessary to increase the speed of the charged particles from the injection device and so the injection voltage.

This means that it would also be necessary to increase the voltage of the inflector electrodes which are currently at around 5 kV, to values close to 15 kV, or even more, for example several tens of kilovolts.

This, of course, would be the cause of a whole series of problems inherent to electrodes, like in particular problems of insufficient insulation or breakdown of the said electrodes.

A final problem stems from the rotational symmetry of the isochronous cyclotron which comprises alternating hills and valleys.

For this type of cyclotron, the focusing takes place by staggered gradients and is particularly delicate at the centre of the cyclotron because the modulation effect of the field due to the hills and valleys disappears at the centre of the cyclotron. In order to remedy this lack of focusing, it is desirable to place a field hump at this point. The presence of the axial hole required by the beam injection is in opposition to the creation of such a field hump.

The documents GOTO A ET AL: "Design of injection system for the IPCR SSC. II" Scientific papers of the Institute of Physical and Chemical Research, December 1980, Japan, vol. 74, no. 4, pages 124-145 and YANO Y ET AL: "Design and Model Study of injection bending magnet for RIKEN SSC" Scientific Papers of the Institute of Physical and Chemical Research, December 1981, Japan, vol. 75, no. 4, pages 176-192 have shown a cyclotron with separate sectors, equipped with an injection device comprising a number of deflection electromagnets. This device is only applicable to separate sector cyclotrons because the deflection electromagnets require space which is not available in the central section of a compact cyclotron. Significant currents are necessary in order to supply these deviation magnets. The injection runs vertically, then at 45°, in the space between two sectors of the separate sector cyclotron, at a distance from the axis of the machine.

AIMS OF THE INVENTION

This invention aims to propose a solution which makes it possible to overcome the different disadvantages of prior art.

This invention aims, in particular, to propose a cyclotron with a novel type of inflector which makes it possible to progressively inflect the charged particle beam originating from an injection device or an external injector positioned axially in relation to the centre of the cyclotron towards the median plane of the said cyclotron with the aim of subjecting it to accelerations.

More precisely, this invention aims to propose a cyclotron equipped with a novel type of inflector which makes it possible to solve the problem of the presence of a field "hump" at the centre of the said cyclotron in the case of an isochronous cyclotron.

MAIN CHARACTERISTIC ELEMENTS

This invention relates to a cyclotron intended for accelerating a charged particle beam with a so-called axial injector, i.e. located externally to the cyclotron and perpendicularly in relation to the median plane and in accordance with the central axis of the said cyclotron, which, combined with inflection means which progressively inflect the particle beam, makes it possible to position the beam in the median plane where the particles will be subjected to the necessary accelerations in the classic manner. These inflection means are essentially positioned at the intersection of the median plane and the axis of the cyclotron.

According to this invention, these inflection means are made up of a magnetic inflector, ie. one or several elements which make it possible to provide the magnetic field with a horizontal or radial component, in such a way as to guide the charged particle beam progressively towards the median plane.

According to a first embodiment, one simply chooses as means of inflection ferro-magnetic elements positioned in such a way as to create an induction field with a horizontal or radial component and which are integral with the cyclotron poles.

According to another preferred embodiment, one uses rings or washers made from stuck blocks of a material which does not modify the axial magnetic field.

This material is preferably a permanent, strong magnet made from an alloy such as a samarium-cobalt or neodymium-iron-boron alloy.

By correctly positioning these rings or washers, one can provide the magnetic field with a horizontal or radial component, thus making it possible to guide the charged particle beam in such a way that it progressively inflects towards the median plane.

DETAILED DESCRIPTION OF SEVERAL EMBODIMENTS OF THE INVENTION

Figure 1:
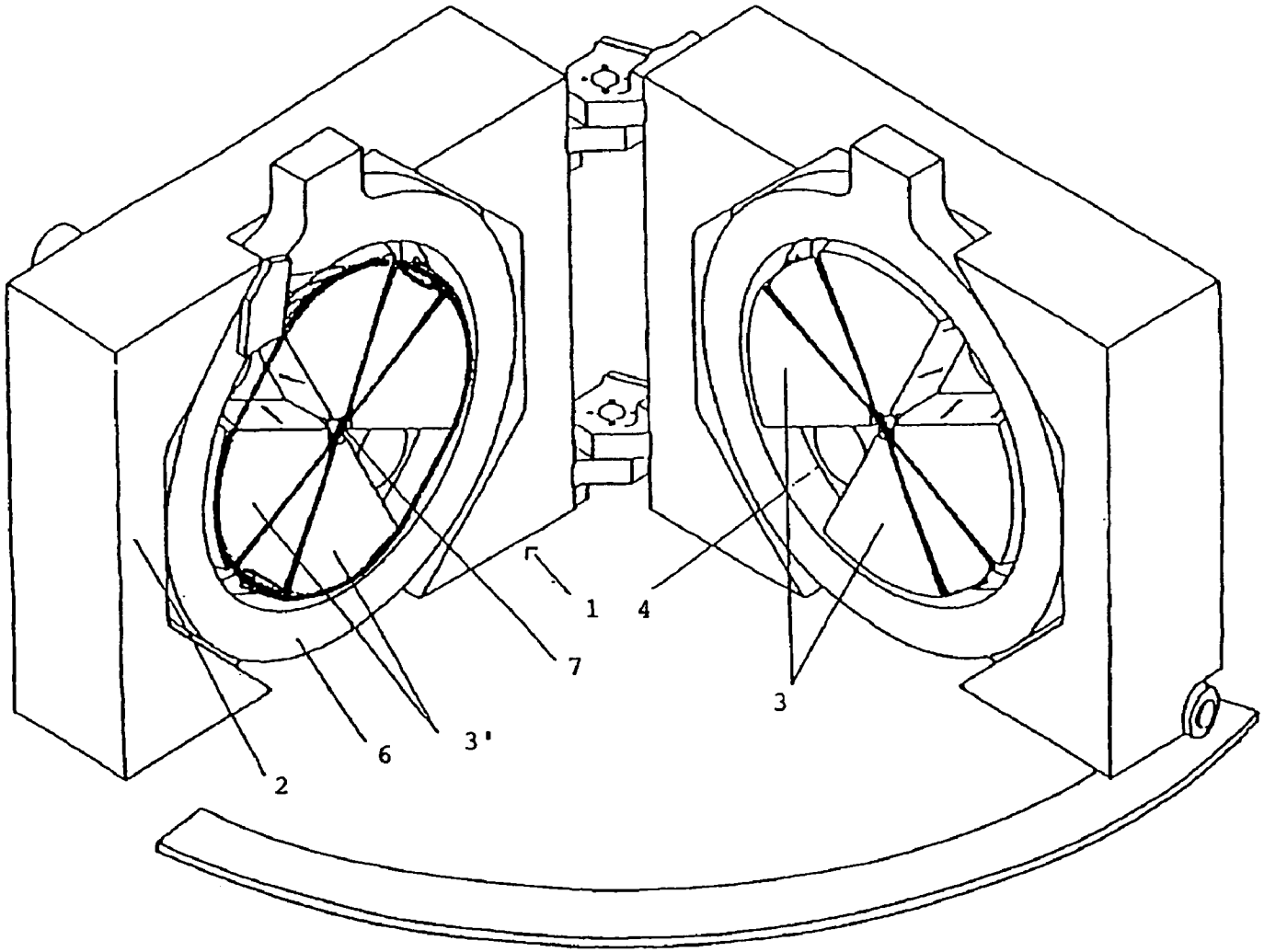
FIG. 1 represents a perspective schematic view of an isochronous cyclotron in which an inflector according to this invention can be used.
Figure 2:
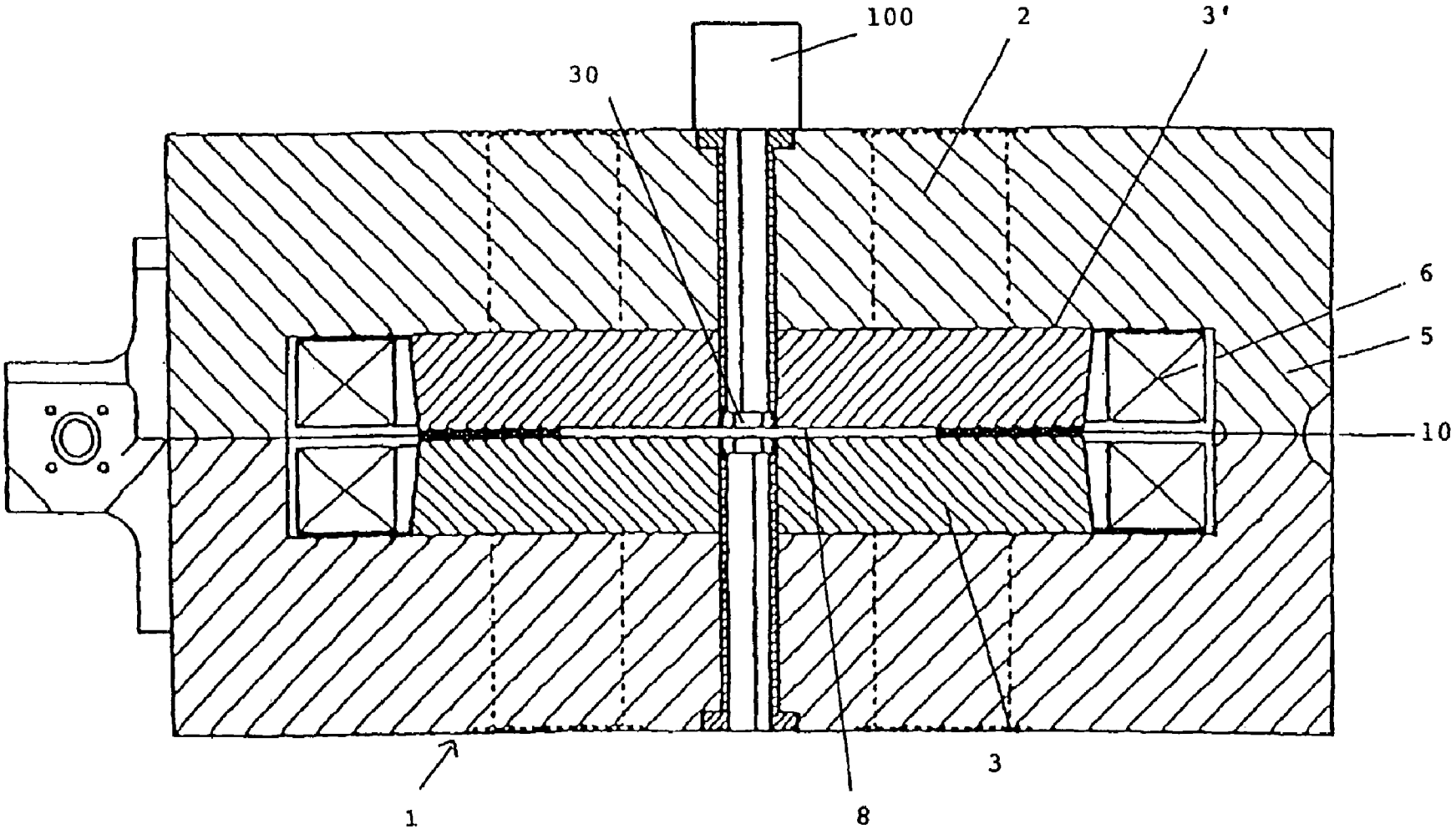
FIG. 2 describes a sectional view of this type of cyclotron.

FIGS. 1 and 2 describe an example of a cyclotron which can use the inflectors according to the various embodiments described below.

The cyclotron 1, as represented, is a compact isochronous cyclotron such as the cyclone 30 produced by the applicant intended for the acceleration of negative particles, such as $H^-$.

The magnetic structure of the cyclotron 1 is represented in FIG. 1 vertically. In the following description, this magnetic structure is positioned in such a way that the median plane is essentially horizontal. It comprises a certain number of elements made from a ferro-magnetic material and from coils 6 made from a conductive or super-conductive material.

The ferro-magnetic structure comprises, in the classic manner:

- two base plates called yokes 2 and 2',
- at least three top sectors 3 called hills and the same number of lower sectors 3' situated symmetrically in relation to a plane of symmetry 10, called the median plane for the top sectors 3, and which are separated by a slight air-gap 8, and defining between two consecutive hills a space where the air-gap has greater dimensions and which is called a valley 4,
- at least one flux return 5 rigidly uniting the lower yoke 2 with the top yoke 2'.

The coils 6 are essentially circular in shape and are positioned in the annular space left between the sectors 3 and 3' and the flux returns 5.

An injection device 100 is positioned in an essentially axial manner, i.e. at a certain distance on the outside of the cyclotron in relation to the median plane 10. In an appropriate manner, this injection device is located on the prolongation of the cyclotron's central axis.

A central conduit 20 is thus created in the yoke, e.g. in the upper yoke, in such a way as to allow the charged particles to be injected into the centre of the apparatus.

In this way, the charged particle beam will be injected in the said conduit and will then be directed, with the help of the inflection elements, until it is positioned in the median plane of the said cyclotron.

For this purpose, an inflector 30 is positioned essentially in the air-gap at the level of the central conduit, and this will make it possible to progressively inflect the particle beam originating from the injection device 100 towards the median plane 10.

According to this invention, the cyclotron presents means of inflection or an inflector which are magnetic. The essential feature of this invention is therefore the fact that this type of inflector does not generate an electric field in the centre of the cyclotron. The inflector according to this invention comprises magnetic materials, i.e. ferro-magnetic materials or permanent magnets, which disturb the cyclotron's axial magnetic field, by thus creating a horizontal or radial component of the said field which will progressively inflect the beam according to the desired path.

Figure 3A:
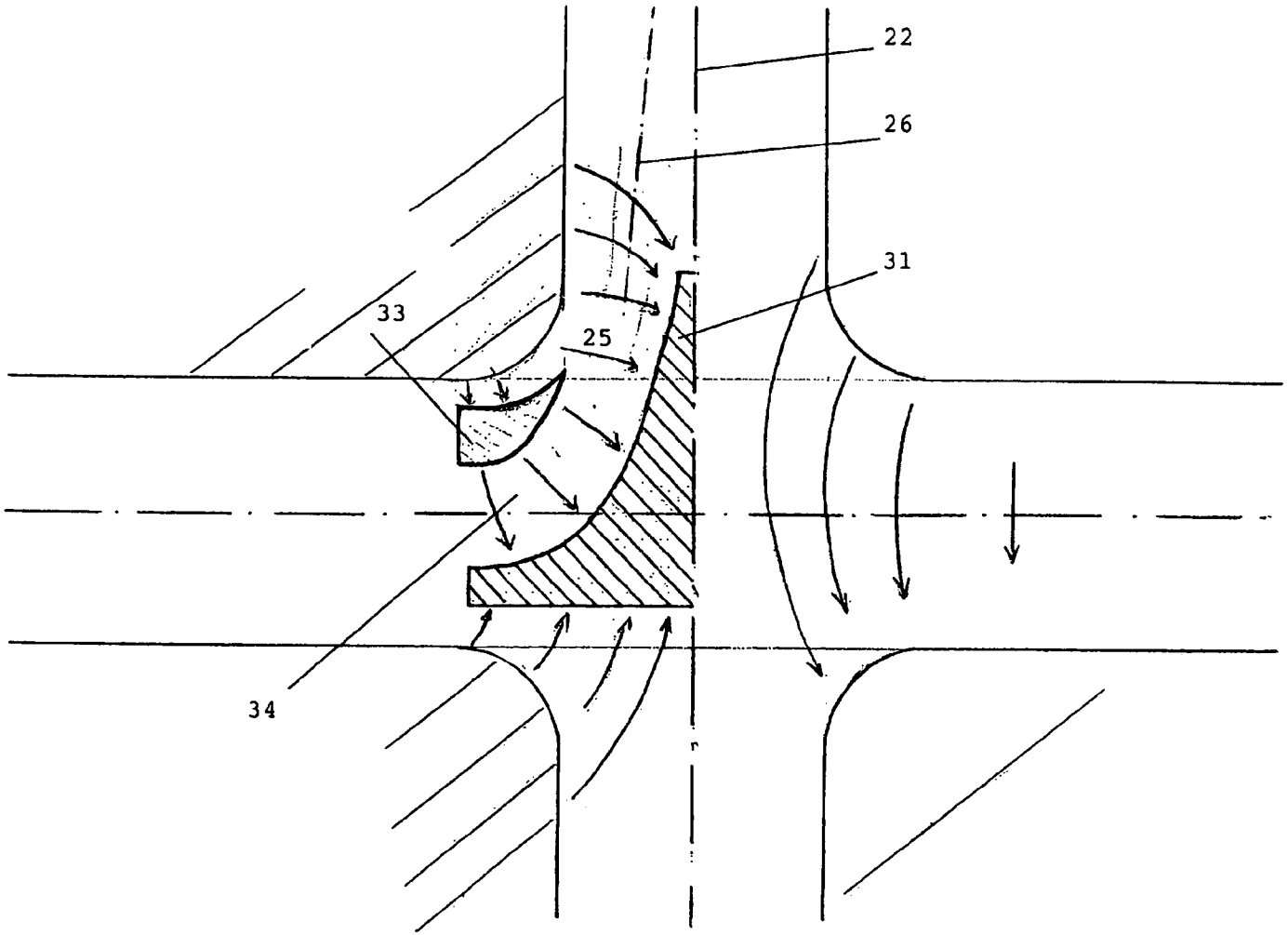
FIGS. 3*a* and 3*b* represent a detailed view—as a plan and as a perspective—of a first embodiment of an inflector according to this invention.
Figure 3B:
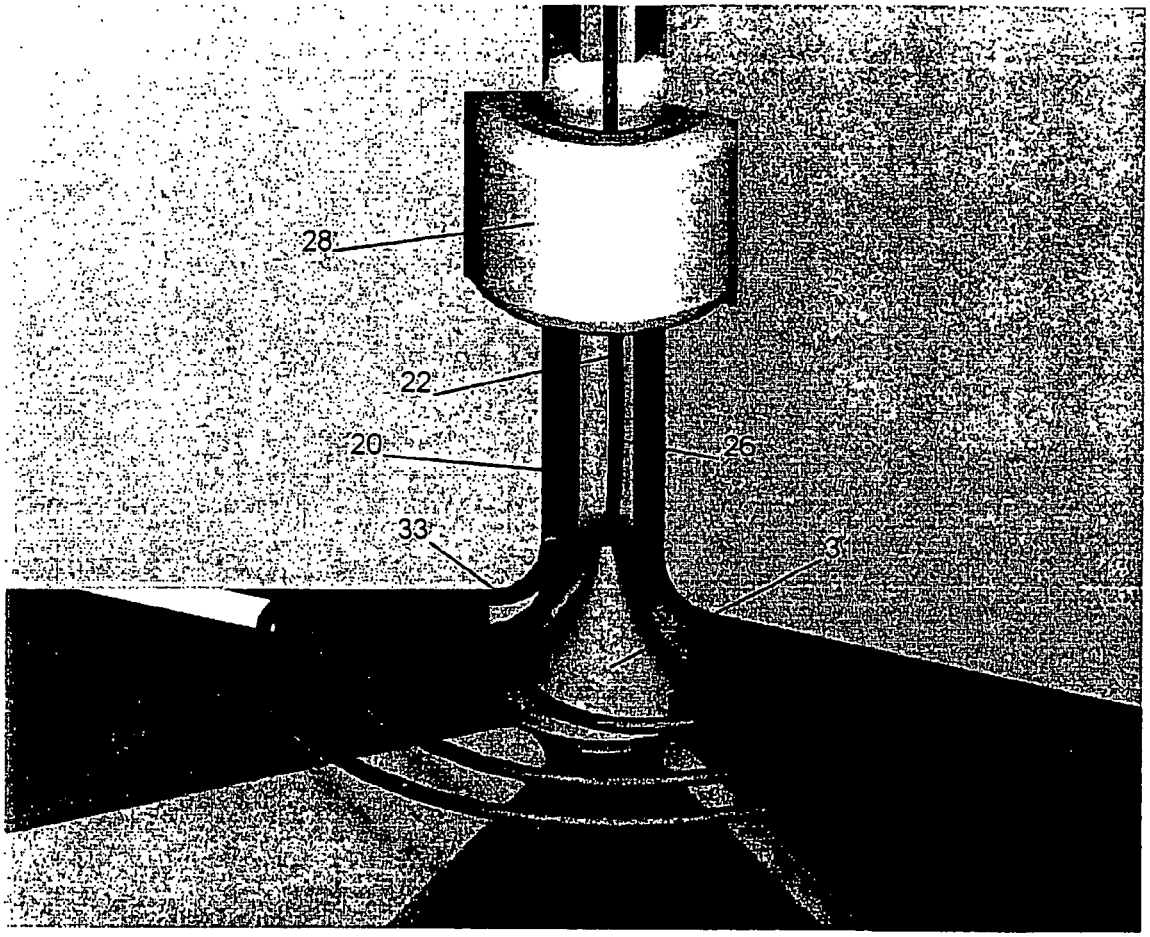

According to a first embodiment described under FIGS. 3*a* and 3*b*, this type of inflector is made up of parts which form the magnetic circuit in the central zone of the cyclotron. These parts are integral with the poles and are made from a ferro-magnetic material which makes it possible to introduce a horizontal or radial component to the magnetic field.

According to a variation of this preferred embodiment, the inflection means are made up of a first element 31 in the form of a cone and of which the axis of symmetry coincides with the axis 22 of the cyclotron and a second element 33 which is essentially in the form of a ring, with the same axis of symmetry, and which essentially surrounds the cone 31, in such a way as to form an annular space 34 between the two elements 31 and 33. These elements are necessarily made from a ferro-magnetic material, such as a steel with a low level of carbon or an iron-cobalt alloy.

The positioning of these will create a disturbance of the magnetic field 25 between the poles of the cyclotron which will allow the desired inflection of the beam 26 in accordance with a path essentially in the form of a spiral helix until it is positioned appropriately in the median plane.

In order to reach this result, a radial component of the magnetic field is thus created by means of inflection. One can see, as represented in FIG. 3*a*, that this type of radial component will be created thanks to the specific form of the elements 31 and 33.

The particle beam will tend to inflect along a path in the form of a spiral helix as represented in FIG. 3*b*.

Because the beam essentially arrives via the top part located above the inflection elements, it must be slightly deflected in relation to the central (and vertical) axis of the cyclotron when it passes between the said means of inflection. For this purpose, guiding coils 28 or other appropriate deflection devices must be incorporated above the inflection elements.

Figure 4:
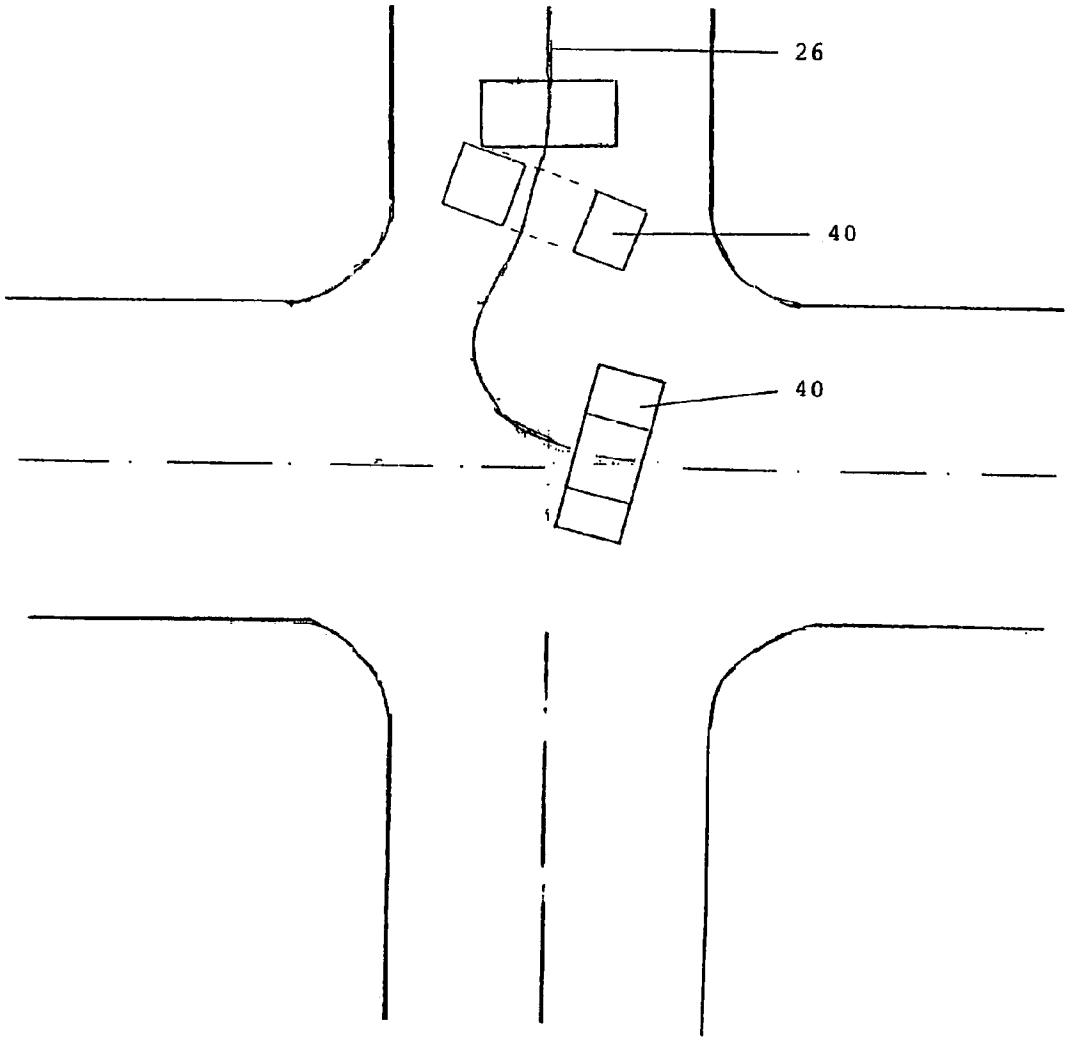
FIG. 4 represents a detailed view of a second embodiment of an inflector according to this invention.

According to another embodiment described under FIG. 4, the inflection means are made up of rings or washers which equally make it possible to provide the magnetic field with a horizontal component. The said rings 40 are made from small elements 41 which are preferably samarium-cobalt magnets.

Figure 5:
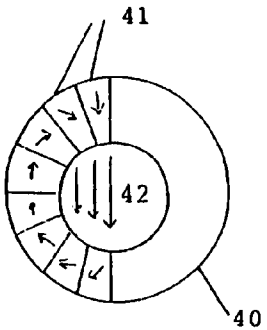
FIG. 5 shows a ring made from Sm—Co used according to a preferred embodiment of the invention described under FIG. 4.

As represented in FIG. 5, each ring is made from elements 41 which are all permanent magnets with individual orientations of the magnetic field which evolve progressively along the perimeter of the ring.

In this way, a uniform field 42 is established within the ring 40. Thanks to the features of the material used, a ring such as that represented by FIG. 5, located in the centre of the cyclotron, will not disturb the essentially axial (vertical) magnetic field which is present in the air-gap of the cyclotron, with the exception of the space situated inside the ring. At this point, an additional component of the magnetic field is created. By positioning the said rings appropriately, one can progressively inflect the particle beam until it is positioned in the median plane.

The solution, as represented by FIGS. 4 and 5, and which corresponds to the second embodiment, makes it possible, by positioning a series of ring-shaped magnets in the centre of the cyclotron, to progressively inflect the beam originating from the axial injector in accordance with a path formed by the central point of successive rings. This path is symbolized by a spiral.

According to this last embodiment, the solution will have the advantage of not requiring the presence of deflection devices, such as guiding coils, upstream from the inflection elements.

A practical example makes it possible to contemplate the acceleration of H particles in a cyclotron of 115 MeV for an injection energy of 80 kV. The magnetic field at the centre will be $B_C$=0.811 T with a magnetic rigidity of 4.15 T·cm. The radius from the centre of the cyclotron will be 5.12 cm, and the connection radius will be between 6 and 7 cm.

The invention claimed is:

1. A cyclotron for the acceleration of a charged particle beam circulating in a median plane, essentially being in the form of two poles inducing a magnetic field and having an axial injector located on the outside of the cyclotron, essentially in accordance with the main axis of the cyclotron, and so perpendicularly to the median plane of the same, and which is combined with inflection means to inflect the particle beam until it is positioned in the median plane, wherein the inflection means are made up of a magnetic inflector, and wherein the inflection means provide the magnetic field with a horizontal or radial component at the level of the center of the cyclotron, thus making it possible to guide the charged particle beam in such a way that it progressively inflects toward the median plane.

2. The cyclotron according to claim 1 wherein the inflection means are made up of rings or washers assembled from individual elements which are permanent magnets.

3. The cyclotron according to claim 1 wherein the inflection means are made up of ferro-magnetic elements integrated with the two poles.

4. The cyclotron according to claim 3, wherein the inflection means comprise a first element in the form of a cone, and a second element in the form of a ring surrounding a section of the said cone.

5. The cyclotron according to claim 4, wherein the axes of symmetry of the elements coincide with the axis of symmetry of the cyclotron.

6. The cyclotron according to claim 3, wherein the cyclotron further comprises, upstream from the inflection means, guiding elements for the beam.

7. The cyclotron according to claim 2, wherein the permanent magnets are made from an alloy selected from the group consisting of samarium-cobalt and neodymium-iron-boron alloy.

8. The cyclotron according to claim 7, wherein the inflection means are made up of a series of rings of which the central points form a trajectory in the form of a spiral helix.

9. A cyclotron for the acceleration of a charged particle beam circulating in a median plane, essentially being in the form of two poles inducing a magnetic field and having an axial injector located on the outside of the cyclotron, essentially in accordance with the main axis of the cyclotron, and so perpendicularly to the median plane of the same, and which is combined with a magnetic inflector to inflect the particle beam until it is positioned in the median plane, wherein the magnetic inflector provides the magnetic field with a horizontal or radial component at the level of the center of the cyclotron, thus making it possible to guide the charged particle beam in such a way that it progressively inflects toward the median plane.

10. The cyclotron according to claim 9, wherein the magnetic inflector comprises a first element in the form of a cone and a second element in the form of a ring surrounding a section of the said cone.

11. The cyclotron according to claim 9, wherein the magnetic inflector comprises ferro-magnetic elements integrated with the two poles.

12. A cyclotron for the acceleration of a charged particle beam circulating in a median plane, essentially being in the form of two poles inducing a magnetic field and having an axial injector located on the outside of the cyclotron, essentially in accordance with the main axis of the cyclotron, and so perpendicularly to the median plane of the same, and which is combined with inflection means to inflect the particle beam until it is positioned in the median plane, wherein the inflection means are made up of a magnetic inflector.

13. The cyclotron according to claim 12, wherein the inflection means comprise a series of rings of which the central points form a trajectory in the form of a spiral helix.

14. The cyclotron according to claim 12, wherein the inflection means provide the magnetic field with a horizontal or radial component at the level of the center of the cyclotron, thus making it possible to guide the charged particle beam in such a way that it progressively inflects towards the median plane.

15. The cyclotron according to claim 12, wherein the inflection means are made up of ferro-magnetic elements integrated with the two poles.

16. The cyclotron according to claim 12, wherein the inflection means comprise a first element in the form of a cone and a second element in the form of a ring surrounding a section of the said cone.

17. The cyclotron according to claim 12, wherein the cyclotron further comprises, upstream from the inflection means, guiding elements for the beam.

18. The cyclotron according to claim 12, wherein the inflection means comprise rings or washers assembled from individual elements which are permanent magnets.

19. A cyclotron for the acceleration of a charged particle beam circulating in a median plane, essentially being in the form of two poles inducing a magnetic field and having an axial injector located on the outside of the cyclotron, essentially in accordance with the main axis of the cyclotron, and so perpendicularly to the median plane of the same, and which is combined with a magnetic inflector to inflect the particle beam until it is positioned in the median plane.

20. The cyclotron according to claim 19, wherein the magnetic inflector comprises of ferro-magnetic elements integrated with the two poles.

* * * * *